US009993870B2

(12) United States Patent
Tremblay et al.

(10) Patent No.: US 9,993,870 B2
(45) Date of Patent: Jun. 12, 2018

(54) HEATED CONTROL PIN

(71) Applicant: PYROTEK HIGH-TEMPERATURE INDUSTRIAL PRODUCTS INC., Chicoutimi (CA)

(72) Inventors: Sylvain Tremblay, Chicoutimi (CA); Jens Bouchard, St-Honoré (CA); Michael Bouchard, Sherbrooke (CA)

(73) Assignee: PYROTEK HIGH-TEMPERATURE INDUSTRIAL PRODUCTS INC., Chicoutimi, Quebec (CA)

( * ) Notice: Subject to any disclaimer, the term of this patent is extended or adjusted under 35 U.S.C. 154(b) by 35 days.

(21) Appl. No.: 15/114,728

(22) PCT Filed: Mar. 21, 2016

(86) PCT No.: PCT/CA2016/050317

§ 371 (c)(1),
(2) Date: Jul. 27, 2016

(87) PCT Pub. No.: WO2016/149812

PCT Pub. Date: Sep. 29, 2016

(65) Prior Publication Data

US 2017/0056973 A1 Mar. 2, 2017

Related U.S. Application Data

(60) Provisional application No. 62/138,755, filed on Mar. 26, 2015.

(51) Int. Cl.

| | |
|---|---|
| ***B22D 41/18*** | (2006.01) |
| ***B22D 37/00*** | (2006.01) |
| ***B22D 2/00*** | (2006.01) |

(52) U.S. Cl.

CPC ..... *B22D 41/18* (2013.01); *B22D 2/005* (2013.01); *B22D 37/00* (2013.01)

(58) Field of Classification Search

CPC ..... B22D 41/18; B22D 37/00

(Continued)

(56) References Cited

U.S. PATENT DOCUMENTS

| | | | |
|---|---|---|---|
| 5,880,046 | A | 3/1999 | Delvaux et al. |
| 7,165,757 | B2 | 1/2007 | Vincent |

(Continued)

FOREIGN PATENT DOCUMENTS

| | | | |
|---|---|---|---|
| CA | 2012235 | A1 | 1/1991 |
| DE | 10035097 | A1 | 2/2002 |

(Continued)

OTHER PUBLICATIONS

International Search Report and Written Opinion of the International Searching Authority for corresponding International Patent Application No. PCT/CA2016/050317 dated May 26, 2016.

*Primary Examiner* — Scott Kastler
(74) *Attorney, Agent, or Firm* — Merchant & Gould P.C.

(57) ABSTRACT

A control pin for controlling the flow of molten metal through a down spout in a casting process is provided. The control pin comprises a body having an elongated shape, a lower portion insertable in the down spout, and a terminal end, opposite the lower portion. The body includes a central core, preferably a hollow tube or a rod of alumina or mullite; a heating element disposed around the central core, and an intermediate layer surrounding the central core and encasing the heating element, the intermediate layer being made of a solidified ceramic putty. Finally, an outer shell, preferably made of woven fiber reinforcing fabric in a matrix of ceramic, surrounds the intermediate layer.

26 Claims, 7 Drawing Sheets

(58) Field of Classification Search
USPC ..... 222/593
See application file for complete search history.

(56) References Cited

U.S. PATENT DOCUMENTS

| | | | | |
|---|---|---|---|---|
| 7,278,464 | B2 | 10/2007 | Vincent | |
| 2010/0032455 | A1 | 2/2010 | Cooper et al. | |
| 2010/0290766 | A1 * | 11/2010 | Mochizuki ..... | H05B 3/78<br>392/503 |

FOREIGN PATENT DOCUMENTS

| | | | |
|---|---|---|---|
| JP | H06262329 | A | 9/1994 |
| JP | H0952155 | A | 2/1997 |
| WO | 2011043759 | A1 | 4/2011 |

* cited by examiner

Temperature of the heated pins A and B in °C, as a function of time (in minutes)

HEATED CONTROL PIN

RELATED PATENT APPLICATION

This application is a National Stage of PCT/CA2016/050317 filed on Mar. 21, 2016, which claims the benefit of U.S. Provisional application No. U.S. 62/138,755, filed on Mar. 26, 2015 and which applications are incorporated herein by reference. To the extent appropriate, a claim of priority is made to each of the above disclosed applications.

TECHNICAL FIELD

The present invention relates to the field of metal casting. More particularly it relates to a control pin for controlling the flow of molten metal from a conveying trough or holding vessel, while maintaining the metal at a desired temperature.

BACKGROUND

A common metal casting process involves pouring liquid metal through a spout and into a mold where the molten metal solidifies to form a billet or slab. The flow of metal through the spout is often controlled by a control pin that is located within the spout. The control pin can be raised in order to increase the rate of flow of metal through the spout, or lowered to decrease or interrupt the flow of metal.

In order to prevent some of the molten metal from solidifying before exiting the spout, the control pin must have a temperature near that of the molten metal. In practice, this means that the control pin must be pre-heated prior to operation. In most cases, this involves heating the control pin in a furnace and, once it attains the desired temperature, manually transferring it to the spout. This process adds a considerable amount of complexity to the casting process, and also gives rise to the risk of a serious accident when transferring the hot control pin from the furnace to the spout.

To avoid such additional complexities and risks in the casting process, a control pin which can be pre-heated in situ is preferred. Known to the applicant is the International Patent Application WO 2011/043759 (COOPER et al.). Cooper discloses a heated control pin comprising an inner cavity, and a heater element placed therein. This design has room for improvement; a configuration allowing the pin to be heated faster and requiring less energy is preferred.

In order to withstand physical wear and the high temperatures of the casting process, control pins are often manufactured using multiple refractory materials. For example, in U.S. Pat. No. 7,165,757, the body of the control pin is made of a laminated composite ceramic material, and the tip of the control pin is made of a different wear-resistant ceramic material. Other pin designs may also use multiple layers of different materials. This can be complex to manufacture, and may also be subject to degradation due to the materials having different thermal expansion coefficients. A control pin which is simple to manufacture and durable is preferred.

It is therefore an object of the present invention to provide a control pin which alleviates at least some of the above-mentioned issues.

SUMMARY

According to a possible embodiment, a control pin is provided. The control pin is typically used for controlling the flow of molten metal through a spout in a casting process. It can also be used to keep the temperature of the spout within a predetermined range of temperatures when the casting process is stopped and the flow of molten metal through the spout is interrupted by the control pin. The control pin can also be used to preheat the spout at the start of the casting process, which advantageously allows saving energy compared to preheating the pin and the spout separately.

The control pin has a body with an elongated shape, a lower portion which is insertable in the spout, and a terminal end, opposite the lower portion. The body includes: a central core having an outer surface; a heating element surrounding the outer surface of the central core; an intermediate layer surrounding the central core and encasing the heating element; and an outer shell surrounding the intermediate layer.

Preferably, the central core is made of a material capable of withstanding temperatures in excess of 660° C., and more preferably in excess of 1000° C. and yet more preferably in excess of 1200° C. For example, the central core can include alumina or mullite. The central core is preferably electrically insulating. The central core is preferably made of a hollow tube, with a central cavity in which a thermocouple can be inserted. In some other embodiments, the central core can be made of a full rod, without the internal cavity.

Preferably, the intermediate layer is made of, or includes, a refractory material. It is typically made of a dried and solidified putty, including one or more of the following components: alumina, mullite, silica, silicon carbide, silicon nitride, zirconia, graphite, and magnesia. The intermediate layer is preferably dense and solid, without any cavities or voids within its thickness.

Preferably, the heating element is a resistive wire wrapped around the central core. The heating element can be helically wound around the central core. The heating element can generate temperatures in excess of 1000° C. There can be a radial spacing between the central core and the intermediate layer, of less than 1 mm, and typically less than 0.5 mm, so as to allow removal of the central core from the control pin at the end of its operational life.

Preferably, the outer shell includes layers of a woven fiber reinforcing fabric embedded in a ceramic matrix. The woven fiber reinforcing fabric can include glass fibers or similar materials. The outer shell may include calcium silicate or silica, or a moldable refractory composition. The moldable refractory composition can be made of at least one of: fused silica, alumina, mullite, silicon carbide, silicon nitride, silicon aluminum oxy-nitride, zircon, magnesia, zirconia, calcium silicate, boron nitride, aluminum nitride and titanium diboride. The outer shell preferably includes an anti-wetting agent.

A tip can be located below the central core and/or the intermediate layer. The tip is preferably embedded and surrounded by the outer shell. The tip is preferably made of a conductive ceramic material and is connected to the intermediate layer with a green set ceramic. For example, the tip can be made of aluminum nitride (AlN), silicon carbide (SiC) or sialon.

According to another aspect of the invention, a control pin assembly is provided. The assembly includes a control pin as described above, a thermocouple inserted in the central core, and a coupling assembly. The coupling assembly includes a mechanical support attachable to the terminal end of the control pin and an electrical connector affixed to the mechanical support. It is possible to incorporate the mechanical support and the electrical connector within a single component. The mechanical support can include, for example, a casing removably attached to the terminal end of the control pin. The casing can include lockable plates pressing, retaining or clamping the terminal end of the control pin. The casing can also possibly include a latch to lock or unlock the plates. The electrical connector preferably includes a first set of electrical connections connectable to the heating element and a second set of electrical connections connectable to the thermocouple. The electrical connector may include a quick connect/disconnect connector, in which a locking element is slid, rotated or twisted to connect and disconnect electrical wires.

The control pin assembly can also include a control box including a first module that controls the current flowing through the heating element, and a second module that monitors a temperature detected by the thermocouple. A cable electrically connects the first and second sets of electrical connections of the electrical connector to the first and second modules of the control box. Preferably, the first module of the control box includes a controller or a processor programmed with at least one heat-up ramp of the heating element. For example, up to four different heat-up ramps can be programmed in the first module.

Advantageously, the control pin allows reducing the safety and handling risk, but also allow both the pin and spout to be heated by the same device, rather than requiring an additional spout heater.

BRIEF DESCRIPTION OF THE DRAWINGS

Other objects, advantages and features of the present invention will become more apparent upon reading the following none-restrictive description of preferred embodiments thereof, given for the purpose of exemplification only, and in reference to the accompanying drawings in which.

DETAILED DESCRIPTION

In the following description, the same numerical references refer to similar elements. For the sake of simplicity and clarity, namely so as to not unduly burden the figures, certain reference numbers are not included in some figures when the features they represent can be easily inferred from the other figures. The embodiments, geometrical configurations, materials mentioned and/or dimensions shown in the figures or described in the present description are preferred embodiments given for exemplification purposes only.

Broadly described, and as better exemplified in the accompanying drawings, the present invention relates to a control pin provided with a heating element such that it can be heated. This invention is especially advantageous for the casting of molten metal. The control pin can be used in replacement of the heating nozzle which is typically used for heating down spouts. It can also replace control pins that were traditionally heated in ovens and transported to and from the casting sites during the casting process. In the control pin of the present invention, the heating element is wrapped around a central core and embedded within a layer of refractory material. An outer shell of layered refractory fiberglass covers the entire pin body. The pin may be provided with internal sensors for generating feedback signals for controlling the state of the heating element. This configuration provides several advantages which will become evident in the following description.

Figure 1A:
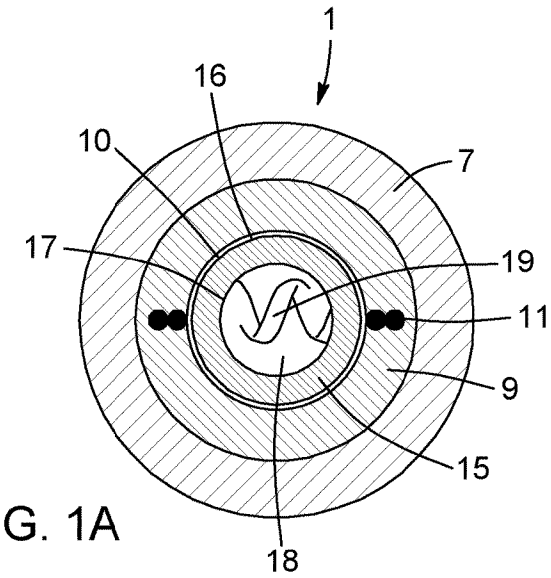
FIG. 1A is a cross-sectional close-up of the terminal end of the control pin of FIG. 1.
Figure 1:
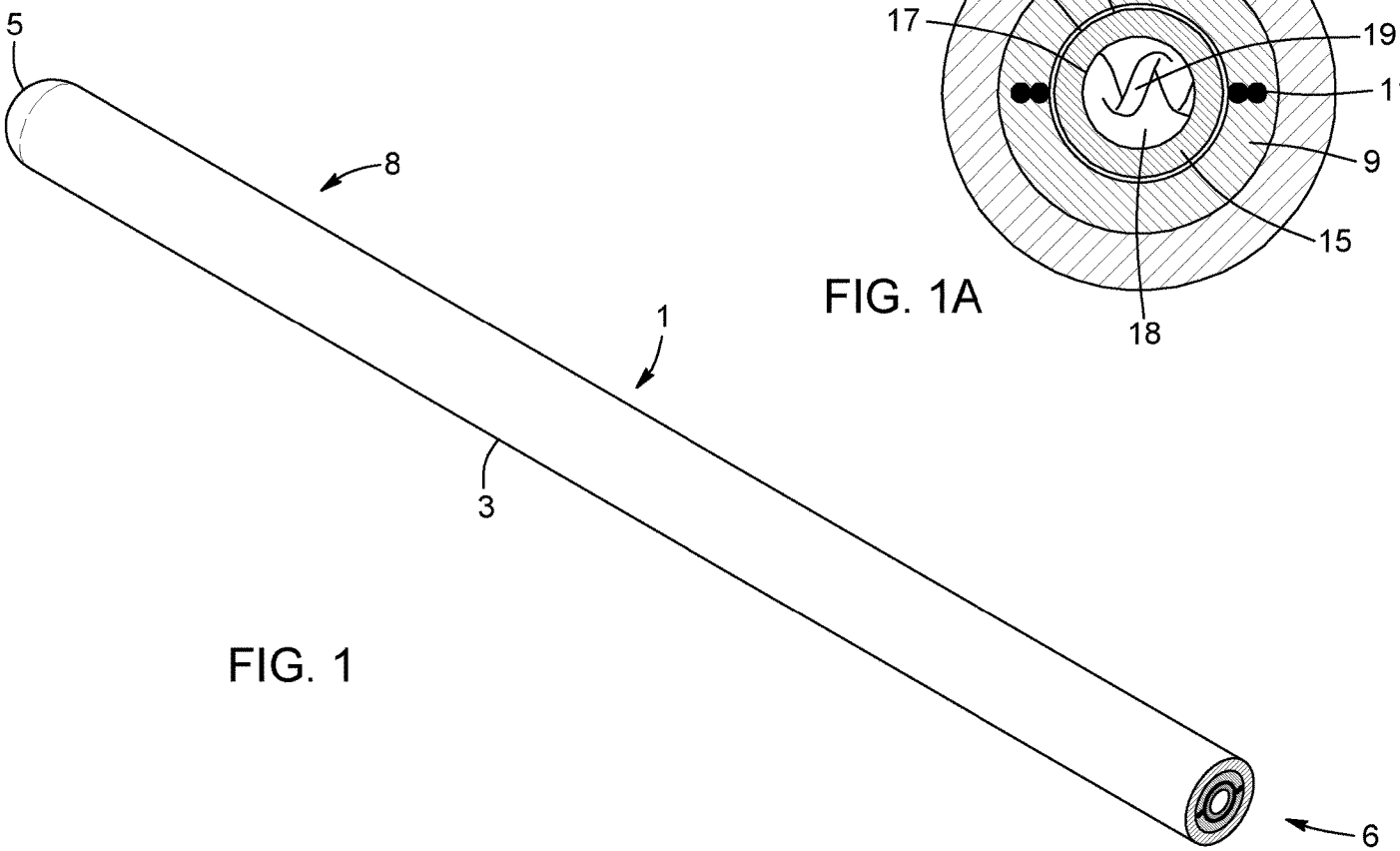
FIG. 1 is a perspective view of a control pin, according to an embodiment.

With reference to FIG. 1, a control pin 1 is shown according to a possible embodiment. The control pin 1 has a body 3, which has an elongated shape, preferably tubular, and is thus shaped to fit in a complementary shaped spout. The body includes a lower portion 8 which is insertable in a down spout. This lower portion 8 has a rounded tip 5 at one end which is shaped such that it can plug the spout and control the flow of liquid therefrom. Although the tip 5 it is rounded in the present illustration, other shapes are also possible. When in operation, the lower portion 8 of the control pin 1 is submerged vertically with the tip 5 being at the lowest point of the spout. The tip 5, the lower portion 8 and possibly the middle portion of the body 3 of the control pin are thus submerged in a pool of molten metal when in use. The control pin can be manufactured at different lengths. In the present example the length of the body is about 760 mm (or 30 inches.)

Since much of the body 3 will be submerged in molten metal, its exterior is preferably made of a uniform refractory material capable of withstanding temperatures in the order of 1200° C. or more. Optionally, the outer surface of the body 3 can be coated with a non-wetting protective coating comprising boron nitride. The tip 5 is a continuation of the body 3, and can be made of the same layer of refractory material without additional seams or joints. Alternatively, the tip 5 can be made of a different material.

Opposite the tip 5 is a terminal end 6. The terminal end 6 is part of the end portion of the control pin 1 which rests above the surface of the molten metal. The terminal end 6 can serve as a mechanical interface, for example to connect the control pin 1 to an actuator that will lower and raise the control pin 1 in the spout. The terminal end 6 can also serve as an electrical interface, for example to provide a connection to electrical components inside the pin. In FIG. 1, the terminal end 6 is shown without a covering for illustrative purposes only: i.e. to clearly show the distinct layers within the control pin 1. In some embodiments, the terminal end 6 may be provided with a protective cap or covering, made from a refractory material for example, which may serve to protect the control pin 1 and its interior components, and/or which may provide additional structural support to the pin and maintain electrical insulation. A mechanical support or connector may also be provided at the terminal end 6 of the control pin 1, as will be described in more detail later with reference to FIGS. 4 to 6.

Referring now to FIG. 1A, a close-up view of the terminal end 6 is provided, in cross-section. As illustrated, the body 3 of the control pin 1 comprises several concentric layers. These layers comprise a central core 15, surrounded by an intermediate layer 9 of refractory material, all of which is covered by an outer shell 7. The intermediate layer 9 includes a heating element 11 encased or embedded within the refractory material. The heating element 11 is typically a resistive wire wrapped around the central core 15, and thus only a portion of the heating element 11 can be seen in the cross-section.

Figure 2:
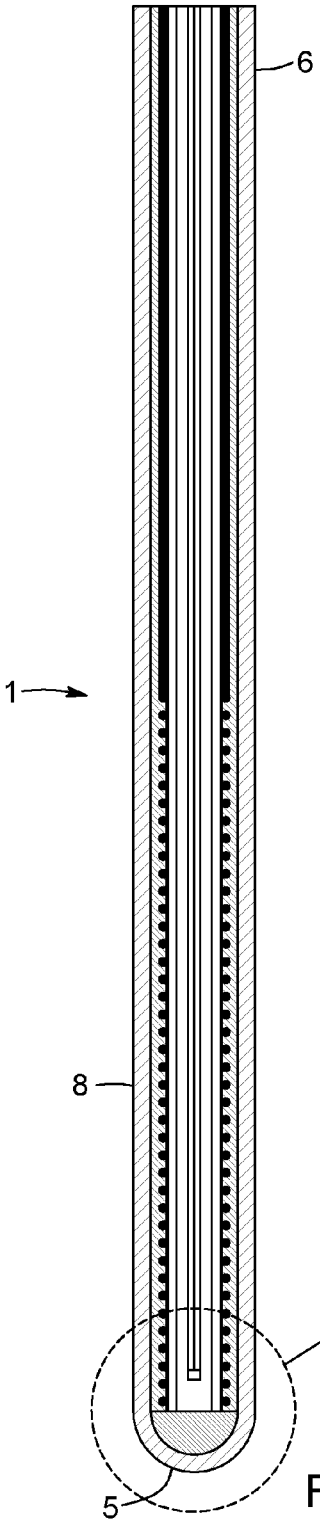
FIG. 2 is a cross-sectional view of the control pin of FIG. 1.
Figure 2B:
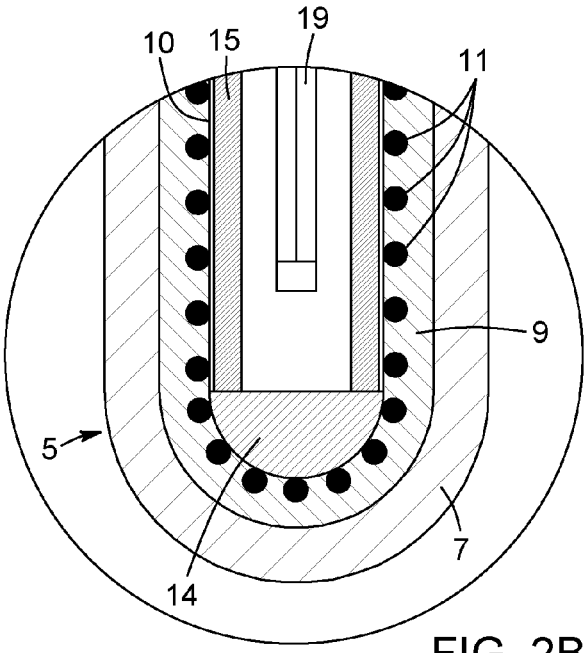
FIG. 2B shows an alternate embodiment of the lower portion of the control pin.
Figure 2A:
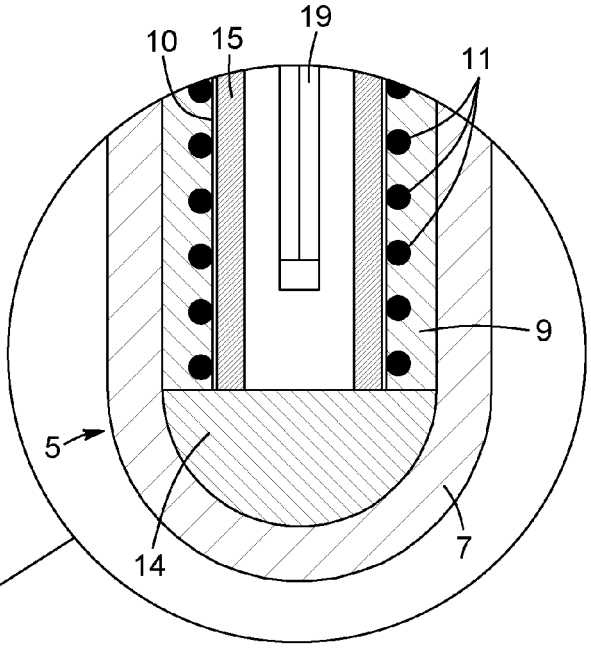
FIG. 2A is a close-up view of the lower portion of the control pin of FIG. 2.

Still referring to FIGS. 1 and 1A, and also to FIGS. 2 and 2A, the central core 15 preferably consist of a cylindrical, hollow tube, extending along the length of the control pin 1. The central core 15 preferably comprises an outer wall 16 which serves as a support upon which the remaining layers of the control pin 1 can be built. The central core 15 is therefore preferably made of a rigid material and defines the general shape of the control pin 1. The core 15 is preferably made from a material that is also electrically insulating and capable of withstanding temperatures of 1200° C. and above. The core 15 is preferably a tube made of alumina (aluminum oxide) or mullite (including aluminum oxide and silicon oxide). Other materials with similar properties can also be used.

The central core 15 is preferably provided with a central cavity 18, in the present case defined by the inner wall 17 of the tube. In one example, the tube can have an inner diameter of 0.5 inch (1.27 cm) and an outer diameter of 0.75 inch (1.91 cm). Of course, other diameter sizes are possible. The central cavity 18 can house internal electrical components. The internal electrical components can be sensors configured to provide feedback for controlling the operation of the heating element 11. Such sensors can include a thermocouple 19, for example, which can provide information about the temperature of the control pin body 3. This temperature information can be used to control the state of the heating element 11 so that the control pin 1 reaches the desired temperature and the heating element 11 does not overheat. In some embodiments, more than one thermocouple can be provided, for example to monitor the temperature of the control pin 1 at different locations along its body 3. In some embodiments, the central core can be full, without any internal cavity. For example, it can be made of a rod, instead of a tube. In some applications, the control pin 1 can be used with a power supply of 110V, and the thermocouple can be omitted. The heating element is simply turned on or off, and a switch can be used to control the current flow in the heating element, without the need of a control panel.

When provided with a thermocouple 19 or other internal electrical components, the central core 15 may serve to electrically isolate the internal electrical components from the remaining outer layers of the control pin 1. For example, the central core 15 can serve as an electrical separation between the thermocouple 19 and the heating element 11 so that they do not interfere with one another or short-circuit.

Still referring to FIGS. 1, 1A, 2 and 2A, the heating element 11 is provided along the outer wall 16 of the central core 15. The heating element 11 is preferably a resistive wire capable of generating heat, preferably in excess of 1100° C. when provided with a current. Preferably, the heating element can withstand temperatures above 1300° C., and still preferably, above 1400° C. The heating element 11 can be arranged around the core 15 in a number of different configurations, preferably so as to heat the refractory material of the control pin 1 evenly and efficiently. In other embodiments, multiple heating elements can be provided. In such cases, an additional insulating layer could be provided between the heating elements so that they do not interfere with one another or short circuit.

Figure 3A:
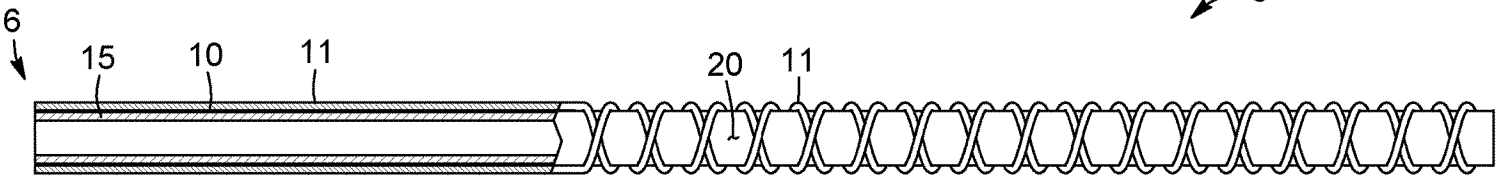
FIG. 3A to 3C are individual views of the control pin at different steps of its manufacturing.

As best illustrated in FIG. 3A, the heating element 11 is preferably helically wound around the core 15. Since it is mainly the lower portion 8 of the control pin that is submersed in molten metal, the heating element 11 is wound more tightly, with each winding turn, in contact or proximate to the adjacent turns, in the lower portion 8 of the control pin. In the upper portion of the control pin, the resistive wire can simply extend vertically along the central core 15, without being necessarily wrapped. In the example of FIG. 3, the wire is wrapped twice (i.e. two sets of turns) around the central core 15. It can also be considered to coil the wire first and then wrap the coiled wire around the core 15, so as to increase the surface between the heating element 11 and the intermediate layer 9. By using a coiled wire, the contact area between outer surface of the wire and the intermediate layer 9, and thus the potential heat exchanges, is maximized. Preferably, the heating element 11 is wrapped around the core 15 such that it extends within most of the thickness of the intermediate layer 9. Preferably, a single wire is wrapped around the core, with two end segments of the wire extending at the terminal end 6 of the control pin. The entire length of the core 15 can be wrapped with a heating wire, or alternatively only the lower portion of the core 15 can be wrapped. Since it is mainly the lower portion 8 of the control pin that will fit in the spout, it can be considered to wrap the heating element only on the lower portion of the core 15.

According to a possible embodiment, a thin layer of fibrous material 20 is provided around at least a portion of the central core 15 prior to winding the heating element 11 around the core 15. This thin layer 20 can be a sheet of paper wrapped around the core 15. During the manufacturing of the control pin, the thin layer 20 will burn and be consumed, leaving a small radial spacing 10, for example less than 0.5 mm, and preferably less than 0.2 mm. This radial spacing 10 will allow for the central core 15 to be removed from the remainder of the control pin, at the end of the operational life of the control pin, so that the central core 15 can be reused for the manufacturing of other control pins. Of course, this spacing is optional and not essential to the working of the control pin. Materials other than paper can be considered for the thin layer of fibrous material 20. While not essential, the advantage of providing a small spacing between the central core is that the core can eventually be reused, thus lowering the overall costs of the control pins, and reducing the consumption of resources.

Figure 3B:
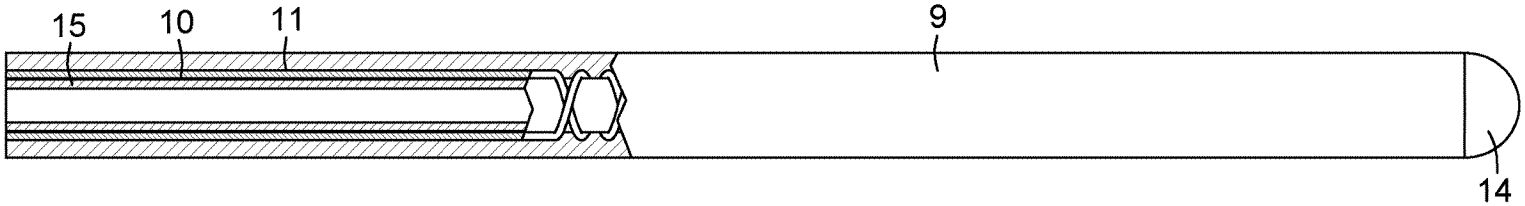

Referring to FIGS. 2, 2A, and 3B, the intermediate layer 9 encases or embeds the heating element 11. The intermediate layer 9 is preferably made of a refractory material. The refractory material of the intermediate layer 9 can be a dried and solidified ceramic putty which preferably has a low heat capacity and which can withstand temperatures in excess of 1200° C. The putty can consist of alumina, silica, magnesia or combination of these materials, or other materials with similar properties. For example, the refractory material can include at least one of mullite, silicon carbide, silicon nitride, zirconia, graphite, and magnesia. The refractory putty serves to bind the heating element 11 around and to the core 15. When the putty has solidified, the heating element 11 retains its configuration around the core 15. The putty is preferably shaped to form the generally cylindrical shape of the control pin 1. The intermediate layer 9 can thus serve as a support for the outer shell 7, the outer shell 7 adhering thereto to form the final shape of the control pin 1. The intermediate layer 9 is preferably dense and solid, without any cavities or voids. The intermediate layer 9 does not necessarily need to extend up to the terminal end 6 of the body of the control pin 1, but it can, as shown in FIG. 2B.

As best shown in FIGS. 2A and 3B, the control pin can comprise a tip 14 located beneath the central core 15 and the intermediate layer 9. The tip is preferably made of a conductive ceramic material and is connected to the intermediate layer 9 with an air-setting mortar or glue, such as green set ceramic. The tip 14 can include one of aluminum nitride (AlN), silicon carbide (SiC) or sialon. The tip 14 is highly heat conductive, allowing for an increased temperature at the rounded end 5 of the control pin, devised to be in contact with the lower end of the down spout, which is more subject to clogging when the casting operation is on hold and the control pin completely blocks the spout. Alternatively, as shown in FIG. 2B, the heating element can extend down to the lower extremity of the control tip, around tip 14.

Figure 3C:
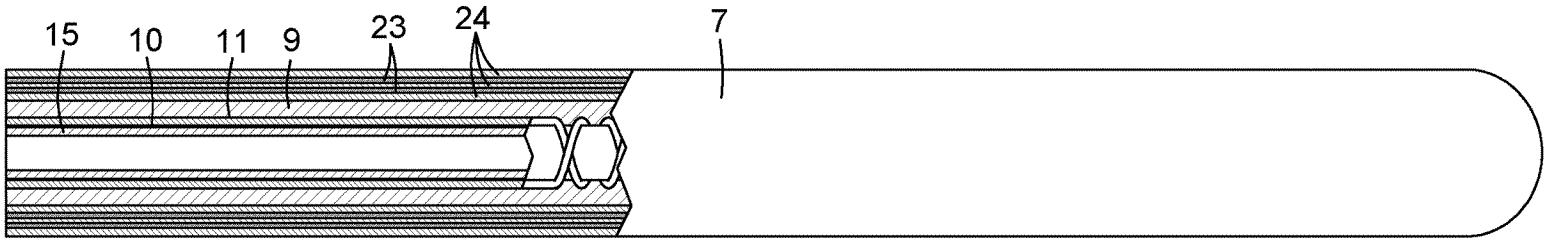

Still referring to FIGS. 2, 2A and 2B, and also to FIG. 3C, the outer shell 7 forms the exterior of the body and is layered on top of the intermediate layer 9 and the tip 14. Preferably, the shell 7 is made of numerous layers of a woven fiber reinforcing fabric 23 embedded in a ceramic matrix 24. The outer shell 7 can have between 2 and 25 layers of the reinforcing fabric 23, and typically between 4 to 10 layers. Preferably still, the fiberglass sheets 23 are arranged so that there are no seems between each layer. The woven fiber reinforcing fabric 23 is preferably made of woven glass, such as S-Glass or E-Glass for example. Various materials may be used for the ceramic matrix, including fused silica, alumina, mullite, silicon carbide, silicon nitride, silicon aluminum oxy-nitride, zircon, magnesia, zirconia, graphite, calcium silicate, boron nitride, aluminum nitride and titanium diboride, or a mixture of these materials. Preferably, the ceramic matrix 24 includes calcium silicate (wollastonite) and silica and comprises a moldable refractory composition as described in U.S. Pat. No. 5,880,046, and which is sold by Pyrotek, Inc. under the trademark RFM. ZR-RFM (which includes zirconium) is preferred. The addition of $ZrO_2$ increases the material refractoriness and enhances the mechanical properties at working temperatures. Preferably, the exterior of the pin is smoothed and/or provided with a coating to prevent it from being wetted by liquid aluminum or other metals. Another optional step may include cooking the pin at two different temperatures, for example between 350° C. and 650° C., to help cure the formed pin. In other embodiments, the pin may be kept inside a mold during the assembly and cooking steps. In some embodiments, the pin may be cooked or simply left to dry before layering the fiberglass material. In yet other possible embodiments of the invention, it is possible to have a single layer of material, surrounding the central core 15 and embedding the heating element 11, without any intermediate layer. For example, for some applications, it can be considered to embed the heating element in the fiber-reinforced ceramic matrix. Preferably, the outer shell 7 comprises an anti-wetting agent, such as $BaSO_4$ or $CaF_2$. The addition of an anti-wetting agent facilitates the removal of a "skin" that forms on the outer surface of the control pin 1 when the control pin cools. This skin must be frequently removed as it may contain undesired contaminants (oxide).

Figure 4:
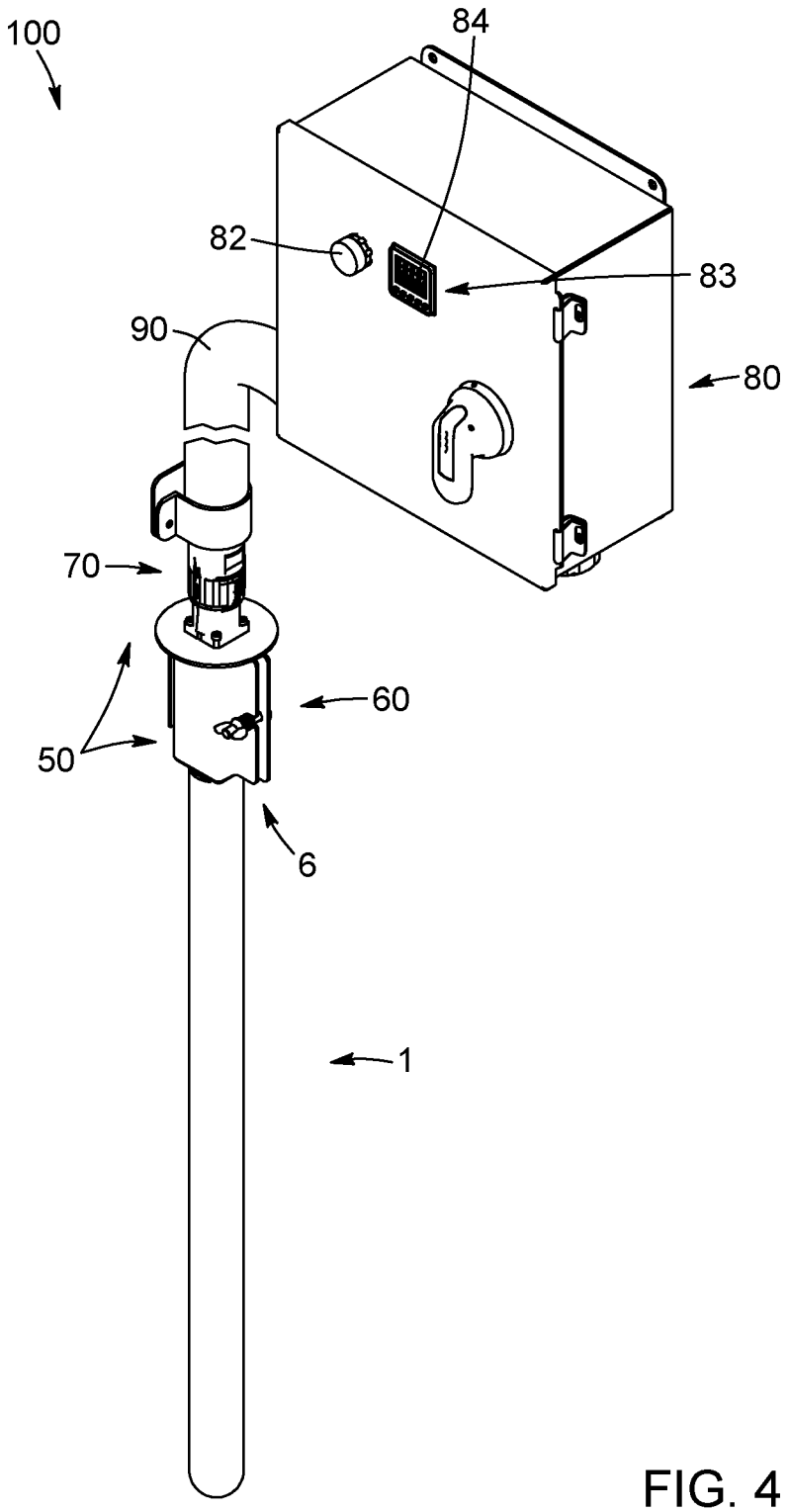
FIG. 4 is a perspective view of a control pin assembly, according to a possible embodiment of the invention.
Figure 5:
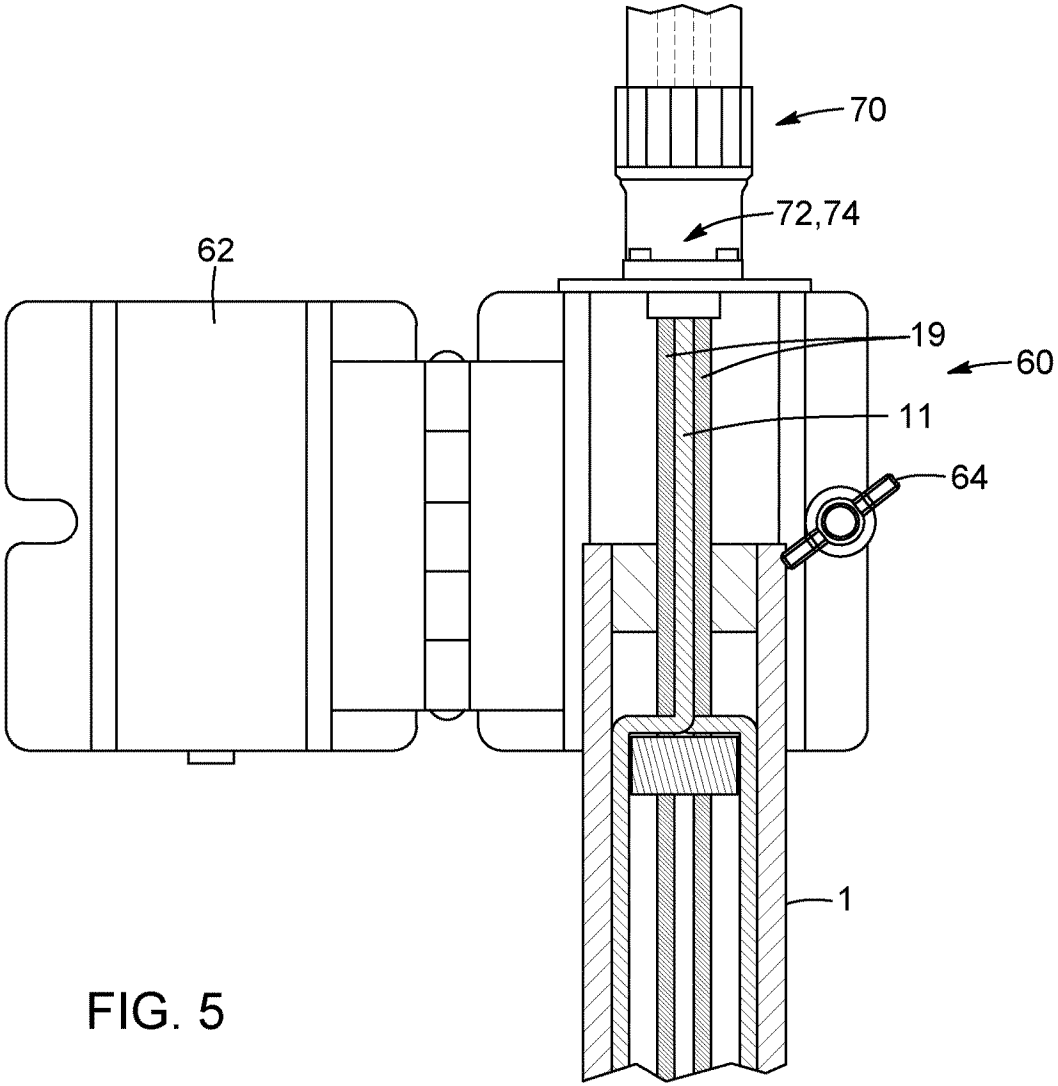
FIG. 5 is a close-up view of a portion of the assembly shown in FIG. 4.

Referring now to FIGS. 4 and 5, a control pin assembly 100 is shown, including a control pin 1 as described above. The control pin assembly 100 also includes a thermocouple 19 (only visible in FIG. 5) inserted in the cavity of the central core 15 and a coupling assembly 50. The coupling assembly 50 includes mechanical and electrical means to support and connect the control pin 1 to other components of the casting environment. Typically, the coupling assembly 50 includes a mechanical support 60, which is attachable to the terminal end 6 of the control pin 1. The coupling assembly 50 also includes an electrical connector 70, preferably affixable to the mechanical support 60. The mechanical support and electrical connector can be integrally made in a single component, or they can be formed as two separate components. The mechanical support 60 holds the control pin 1 and can be used to provide a grip for the controlling arm (not shown) that will lower and raise the control pin 1 in and out of the spout. The mechanical support 60 also serves to protect and isolate the electrical components (resistive heating wires and thermocouple) at the terminal end 6 of the control pin 1. According to a possible embodiment, the mechanical support 60 includes a casing removably attachable to the terminal end 6 of the control pin 1. The casing clasps and holds tightly the terminal end 6 of the control pin 1, holding it between two plates. One of the plates can be used as a door 62. A latch 64 allows attaching or removing the support 60 from the control pin 1.

Still referring now to FIGS. 4 and 5, the electrical connector 70 preferably includes first set of electrical connections 72 connectable to the heating element 11 and second set of electrical connections 74 connectable to the thermocouple 19. Preferably, the connector includes a quick connect/disconnect type connector, where a ring can be slid or turned so as to connect and disconnect the wires from the heating element 11 and/or from the thermocouple 19.

The control pin assembly 100 also preferably includes a control box 80 and a cable 90. The control box 80 includes at least a first module 82 that controls the current flowing in the heating element 11 and a second module 84 that monitors a temperature detected by the thermocouple 19. The cable 90 electrically connects the first and second sets of electrical connections 72, 74 of the electrical connector 70 to the first and second modules 82, 84 of the control box 80. While the control box is shown with only two cable entries, it is possible for the control box to include more or less cable entries, and more or less control modules. Advantageously, a single control box 80 can be used to control heating of a plurality of control pins.

According to a possible embodiment, the control box 80 can include a controller or a processor 83 programmed with one or more heat-up ramp(s) for the heating element 11. For example, when first heating the control pin 1, the heat-up ramp can be slower, with a rate of about 150° C./hour. After a predetermined time, the control pin may be heated at a higher rate, such as above 200° C./hour. One to five heat-up ramps can be pre-programmed in the controller. Temperature feedback information is fed from the thermocouple 19 to the controller 83 and the current flowing in the heating element 11 is controlled based on the temperature detected by the thermocouple 19. The controller 83 can also act as an on/off switch, or as a dimmer, to provide a specific amount of current in order to attain a desired temperature. Preferably, a heating module in the control box works with 240V, providing up to 5000 Watts, with a current up to 20.8 amps. The resistance of the heating element can be, for example, between 12 and 18 ohms. Being able to control the rate of heat during the first timed interval of heating is especially advantageous since cracks, splits or other defaults typically occur during the first phase of heating, when the control pin passes from an ambient temperature to a higher temperature. Once the risk of cracking and splitting is reduced, i.e. when the control pin 1 has reached a predetermined minimal temperature, the heat-up ramp can be raised, such that the time to heat the control pin 1 to a predetermined set point is reduced. For example, a first heat up ramp can be programmed at 150° C./hour until the temperature measured by the thermocouple is 200° C., and then a second heat-up of 300° C./hour can kick in until the thermocouple detects a set point temperature of 800° C. The set point temperature for the heating element can vary from 800° C. to 1000° C., and preferably between 850° C. to 950° C.

The table below compares the temperatures measured in a spout and control pin according to a prior art method, with those measured in a spout and control pin according to the present invention. In the traditional method, the control pin is heated in an oven at temperatures between 600° C. and 850° C., and the spout is heated using a cartridge heater. In the experiment using a control pin of the present invention, the spout was heated from the heat transfer of the control pin. The set point of the heating element was varied from 800° C. to 1100° C. and the temperatures of the inner wall of the spout, and the outer surface of the control pin were measured after 30 min. of heating. As can be appreciated, when using the control pin of the present invention, the temperatures of the surfaces of the spout and of the control pin are much higher than those reached when using a traditional cartridge heater and control pin, without any heating element embedded therein.

TABLE 1 temperatures measured in a spout and a control pin according to a traditional method vs. using a control pin according to the present invention

| | Traditional control pin Oven temperature | Heated control pin (set point of heating element) | | |
|---|---|---|---|---|
| Component | 800° C. | 850° C. | 900° C. | 950° C. |
| Spout | ±300° C. | 387° C. to 400° C. | 410° C. | 428° C. |
| Control pin | ±400° C. | 528° C. to 543° C. | 571° C. | 592° C. |

Figure 6:
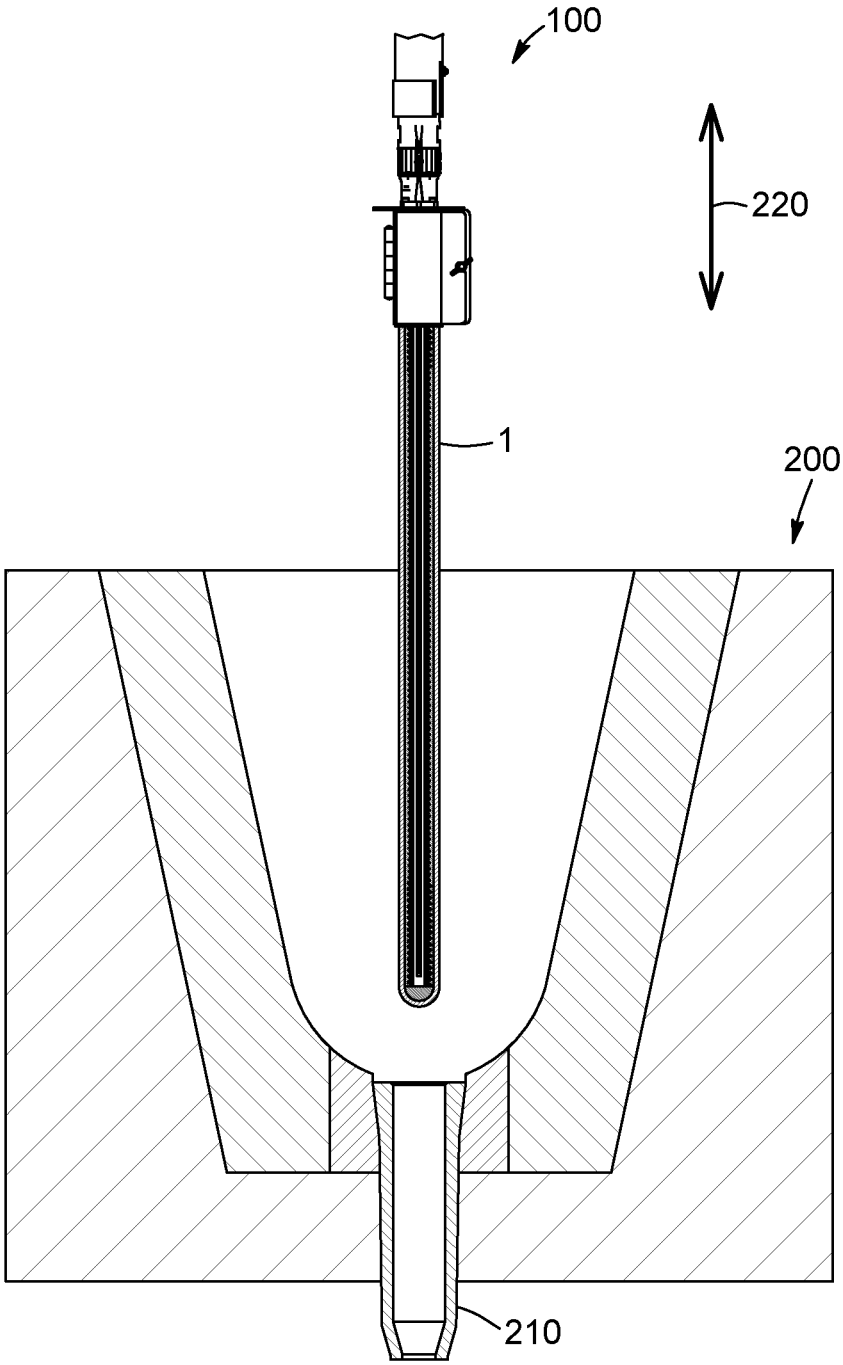
FIG. 6 is a cross-section view of the control pin assembly of FIG. 4, shown suspended above the down spout of a casting process.

FIG. 6 shows the control pin 1 in a casting environment. The control pin is suspended above a launder or trough 200, provided with a spout 210. A controlling arm or other similar mechanism (not shown) lowers and raises the control pin 1 in and out of the spout 210, vertically along arrow 220. The outer diameter of the control pin is selected to fit within the spout.

The described configurations provide several advantages over the control pins of the prior art. A major advantage is that the control pin can be heated without needing to be removed from its spout. The control pin is effectively self-heating and does not require an external heat source in order to reach its operational temperature. It can therefore be heated in situ, eliminating the hazard of manually transporting a dangerously hot pin, reducing the complexity of the molding process, and allowing more steps of the casting process to be automated.

The arrangement of the heating element within the body also results in a more efficient heat transfer between the heating element and the body of the pin. This is in contrast to existing configurations where the heating element is disposed in the center of the pin, for example inside the cavity of the core. The result is that the pin of the present invention can be heated to its operational temperature more rapidly and with less energy when compared to traditional heated pins.

Figure 7:
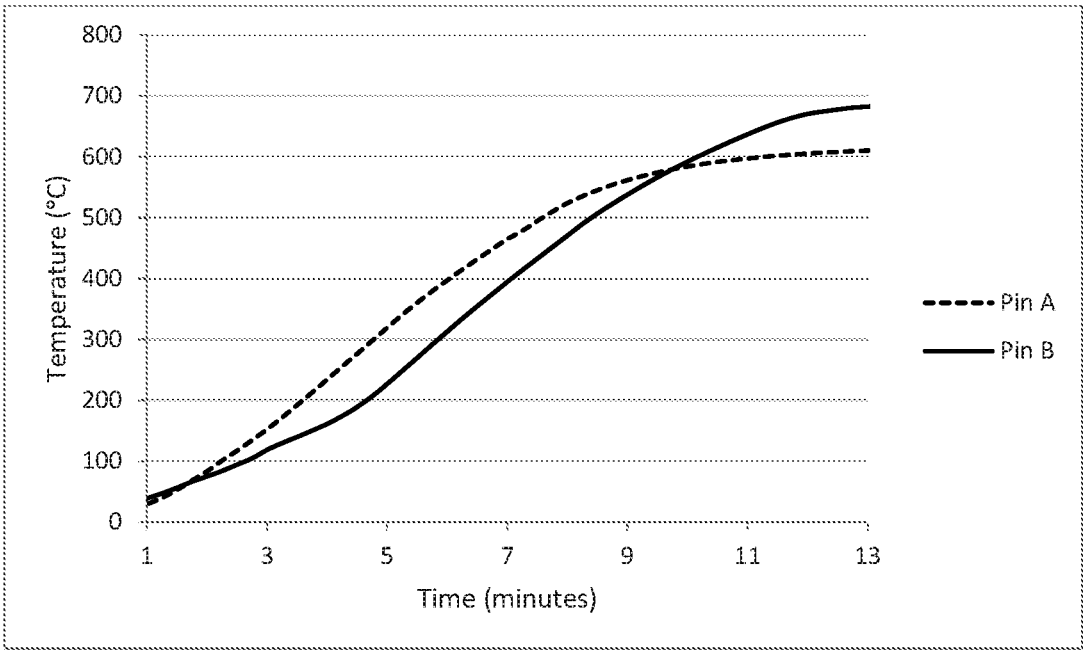
FIG. 7 is a graph illustrating the heating curves of two pins: pin A with a heating element provided inside the central cavity of the core (dashed curve), and pin B with a heating element provided around the core (solid curve). For both pins, the heating element was heated to 800° C., at time 0, and temperature was measured 2 inches from the tip of the pin.

With reference to FIG. 7, resulting from a another experiment, a comparison is provided between the heating curves of two pins: the first one with a heating element provided inside the central cavity of the core (dashed curve, Pin A), and the second one with a heating element provided around the core (solid curve, Pin B) as provided for in the present invention. In both cases, the heating element was heated to 800° C., at time 0, and temperature was measured 2 inches from the tip of the pin. As is evident from the graph, Pin B was able to approach 700° C. within 13 minutes. In contrast, Pin A barely surpassed 600° C. in that same time frame before eventually reaching a plateau. In order to reach the melting point of aluminum (approx. 660° C.) and thus be adequate for aluminum casting, Pin A would need a more powerful heating element and thus more energy would be required to attain the pin's operating temperature. In contrast, an 800° C. heating element is sufficient for Pin B. In addition, with Pin B, not only the heat from the control pin is generated closer to the outer surface, along the length of the pin but it is also generated closer to the tip, where is it most needed.

Another advantage of the present invention is that there is an effective electrical isolation between the heating element and the thermocouple. In the described embodiments, the heating element is wrapped around the core, while the thermocouple is disposed inside the core. The walls of the core thus separate these two electrical components thereby reducing the risk of short circuiting. As a result, the thermocouple can provide more accurate and reliable readings.

Yet another advantage, for at least some possible embodiments of the control pin, is that the exterior of the pin is a single continuous piece, without any seams. This makes it more durable, less susceptible to cracking, and avoids the risk of liquid metal infiltrating through expanding seems when the pin is heated. Additionally, the pin is made of a reinforced fiberglass refractory material from top to bottom, making the entirety of the pin heat resistant and not susceptible to separation due to mismatched coefficients of thermal expansion.

These are but some advantages of the present invention. Other advantages may be apparent to one skilled in the art upon reading the present disclosure.

Although the heating pin was described hereinabove in connection with controlling the flow of molten metal from a conveying trough or holding vessel, a person of the art will understand that it can have other useful application as well. For example, in some configurations, the technology of the present invention can be used as a low cost immersion heater. The heating elements can be wrapped more tightly, and the thickness of the wires can be varied so as to increase the overall heat output of the pin. For example, the windings can be configured so as to generate a heat output of around 7 kW. In such a configuration, the pin may generate sufficient heat to maintain liquid metal in a liquid state. The pin can be submerged in liquid metal, such as aluminum, zinc or magnesium for example, and maintain the metal at a desired temperature. In so doing, the outer shell can serve to protect the heating elements and electrical components encased in the pin.

The present invention should not be limited to the preferred embodiment set forth in the examples but should be given the broadest interpretation consistent with the description as a whole.

The invention claimed is:

1. A control pin for controlling flow of molten metal through a down spout in a casting process, the control pin comprising:

a body having an elongated shape, a lower portion insertable in the down spout, and a terminal end, opposite the lower portion, the body comprising:

an electrically insulating central core;

a heating element disposed around the central core, an intermediate layer surrounding the central core and encasing the heating element; and an outer shell surrounding the intermediate layer.

2. The control pin according to claim 1, wherein the central core is a hollow tube.

3. The control pin according to claim 1, wherein the central core is made of a material resisting temperatures in excess of 1200° C.

4. The control pin according to claim 1, wherein the central core comprises alumina.

5. The control pin according to claim 1, wherein the central core comprises mullite.

6. The control pin according to claim 1, wherein the intermediate layer comprises refractory material.

7. The control pin according to claim 1, wherein the intermediate layer comprises a dried and solidified putty comprising at least one of: alumina, mullite, silica, silicon carbide, silicon nitride, zirconia, graphite, and magnesia.

8. The control pin according to claim 1, wherein the intermediate layer is dense and solid, without any cavities or voids.

9. The control pin according to claim 1, wherein the heating element is capable of generating heat in excess of 1100° C.

10. The control pin according to claim 1, comprising a radial spacing between the central core and the intermediate layer.

11. The control pin according to claim 10, wherein the radial spacing is less than 1 mm.

12. The control pin according to claim 1, wherein the outer shell comprises layers of a woven fiber reinforcing fabric embedded in a ceramic matrix.

13. The control pin according to claim 12, wherein the woven fiber reinforcing fabric comprises glass.

14. The control pin according to claim 1, wherein the outer shell comprises calcium silicate or silica and a moldable refractory composition.

15. The control pin according to claim 14, wherein the moldable refractory composition comprises at least one of fused silica, alumina, mullite, silicon carbide; silicon nitride, silicon aluminum oxy-nitride, zircon, magnesia, zirconia, calcium silicate, boron nitride, aluminum nitride and titanium diboride, and mixtures of these materials.

16. The control pin according to claim 1, wherein the central core and the intermediate layer have respective lower extremities, the control pin comprising a tip located at the lower extremities of the central core and of the intermediate layer, the tip being surrounded and embedded in the outer shell.

17. The control pin according to claim 16, wherein the tip comprises a conductive ceramic material and is connected to the intermediate layer with an air-setting mortar or glue.

18. The control pin according to claim 16, wherein the tip comprises one of aluminum nitride (AlN), silicon carbide (SiC) and sialon.

19. The control pin according to claim 1, wherein the outer shell comprises an anti-wetting agent.

20. The control pin according to claim 1, wherein the central core comprises a central cavity, the control pin comprising a thermocouple inserted within the central cavity of the central core.

21. A control pin for controlling a flow of molten metal through a down spout in a casting process, the control pin comprising:

a body having an elongated shape, a lower portion insertable in the down spout, and a terminal end, opposite the lower portion, the body comprising:

a tube or rod made of alumina or mullite;

a resistive wire wrapped around the tube or rod;

an intermediate layer of dried and solidified ceramic putty, surrounding the tube or rod and encasing the resistive wire;

a tip made of an electrically insulating and heat conducting material, located below the tube or rod and the intermediate layer, and an outer shell surrounding the tip and the intermediate layer, the outer shell comprising multiple layers of reinforcing fabric, embedded in a ceramic matrix.

22. A control pin assembly, comprising:

a control pin according to claim 1;

a thermocouple inserted in the central core; and a coupling assembly including:

a mechanical support attachable to the terminal end of the control pin; and an electrical connector affixed to the mechanical support, the electrical connector comprising a first set of electrical connections connectable to the heating element and a set of electrical connections connectable to the thermocouple.

23. The control pin assembly according to claim 22, wherein the mechanical support comprises a casing removably attachable to the terminal end of the control pin.

24. The control pin assembly according to claim 22, further comprising:

a control box comprising a first module controlling current flowing in the heating element; and a second module monitoring a temperature detected by the thermocouple; and a cable electrically connecting the first and second sets of electrical connections of the electrical connector to the first and second modules of the control box.

25. The control pin assembly according to claim 24, wherein the control box comprises a processor programmed with at least one heat-up ramp of the heating element, with a rate of at least 150° C./hour.

26. The control pin assembly according to claim 25, wherein the processor is programmed with more than one heat-up ramp up of the heating element.

* * * * *